US011849284B2

(12) United States Patent
Guo et al.

(10) Patent No.: US 11,849,284 B2
(45) **Date of Patent: *Dec. 19, 2023**

(54) FEEDBACK CONTROL USING A CORRELATION MEASURE

(71) Applicant: Oticon A/S, Smørum (DK)

(72) Inventors: Meng Guo, Smørum (DK); Bernhard Kuenzle, Berne (CH)

(73) Assignee: Oticon A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/976,154

(22) Filed: Oct. 28, 2022

(65) Prior Publication Data

US 2023/0048848 A1 Feb. 16, 2023

Related U.S. Application Data

(63) Continuation of application No. 17/397,439, filed on Aug. 9, 2021, now Pat. No. 11,516,600.

(30) Foreign Application Priority Data

Aug. 10, 2020 (EP) ..... 20190305

(51) Int. Cl.
*H04R 25/00* (2006.01)

(52) U.S. Cl.
CPC ..... *H04R 25/453* (2013.01); *H04R 25/353* (2013.01); *H04R 25/505* (2013.01); *H04R 2225/43* (2013.01)

(58) Field of Classification Search
CPC .. H04R 25/353; H04R 25/453; H04R 25/505; H04R 2225/43; H04R 2460/01
See application file for complete search history.

(56) References Cited

U.S. PATENT DOCUMENTS

2002/0094100 A1* 7/2002 Kates ..... H04R 25/356 381/317
2009/0175474 A1 7/2009 Salvetti et al.
(Continued)

FOREIGN PATENT DOCUMENTS

EP 2 736 271 A1 5/2014
EP 3 148 214 A1 3/2017
WO WO 2007/053896 A1 5/2007

OTHER PUBLICATIONS

Guo et al., "On the periodically time-varying bias in adaptive feedback cancellation systems with frequency shifting", 2016 IEEE International Conference on Acoustics, Speech and Signal Processing (ICASSP), 2016, pp. 539-543.

*Primary Examiner* — Suhan Ni
(74) *Attorney, Agent, or Firm* — Birch, Stewart, Kolasch & Birch, LLP

(57) ABSTRACT

A hearing aid is configured to be worn in and/or at an ear of a user, and comprises a) an input transducer for converting an input sound to an electric input signal representing sound, h) an output transducer for converting a processed electric output signal to an output sound, c) a signal processor operationally coupled to the input and output transducers and configured to apply a forward gain to the electric input signal or a signal originating therefrom, wherein the input transducer, the signal processor and the output transducer forming part of a forward path of the hearing aid. The hearing aid further comprises d) a feedback control system for compensating for acoustic or mechanical feedback of an external feedback path from the output transducer to the input transducer, wherein the feedback control system comprises i) a feedback estimation unit for providing a feedback estimate signal of said external feedback path, ii) a combination unit located in the forward path for combining the electric input signal or a signal derived therefrom and the (Continued)

feedback signal detected by said estimation unit, to provide a resulting feedback corrected signal, iii) a correlation detection unit configured to determine a correlation measure between said feedback corrected signal and said output signal, said correlation detection unit further configured to provide a processed version of said correlation measure.

20 Claims, 4 Drawing Sheets

(56) References Cited

U.S. PATENT DOCUMENTS

| | | | | |
|---|---|---|---|---|
| 2010/0020981 | A1* | 1/2010 | Elmedyb | H04R 25/453 381/71.11 |
| 2015/0078600 | A1 | 3/2015 | Rasmussen et al. | |
| 2018/0007476 | A1* | 1/2018 | Durrieu | H04R 25/453 |
| 2019/0198037 | A1* | 6/2019 | Bucher | G10L 21/0232 |

* cited by examiner

FEEDBACK CONTROL USING A CORRELATION MEASURE

CROSS REFERENCE TO RELATED APPLICATIONS

This application is a Continuation of co-pending U.S. patent application Ser. No. 17/397,439, filed on Aug. 9, 2021, which claims priority under 35 U.S.C. § 119(a) to European Patent Application No. EP 20190305.1 filed on Aug. 10, 2020. The entire contents of which are hereby incorporated by reference.

FIELD

The present disclosure relates to hearing aids adapted to compensate for a moderate to severe or severe to profound hearing loss. The present application relates to feedback control (e.g. cancellation) in hearing aids, in particular in acoustic situations where sound signals comprising tonal components (e.g. music) are present. The disclosure is particularly focused on minimizing audibility of artefacts. The disclosure relates specifically to a hearing aid comprising a feedback control system configured to estimate a correlation measure of a feedback-compensated electric input signal and further being configured to provide a processed version of said correlation measure.

BACKGROUND

Acoustic feedback problems occur due to the fact that the output loudspeaker signal of a hearing aid system is partly returned to the input microphone via an acoustic coupling, e.g. through the air. The part of the loudspeaker signal returned to the microphone is then re-amplified by the system before it is re-presented at the loudspeaker, and again returned to the microphone, etc. As this cycle continues, the effect of acoustic feedback becomes audible as artefacts or even worse, howling, when the system becomes unstable. The problem appears typically when the microphone and the loudspeaker are placed closely together, as in hearing aids, and often causes significant performance degradation. Unstable systems due to acoustic feedback tend to significantly contaminate the desired audio input signal with narrow band frequency components, which are often perceived as howl or whistle. A variety of feedback cancellation methods have been described to increase the stability of audio processing systems in hearing aids. One of the state-of-the-art solutions for reducing the effects of acoustic feedback is a cancellation system using an adaptive filter. Indeed, the feedback path of a hearing aid system, may vary over time. Adaptive feedback cancellation has the ability to track feedback path changes over time and is e.g. based on an adaptive filter to estimate the feedback path. The adaptive filter weights are calculated and updated over time by an adaptive algorithm and the timing of calculation and/or the transfer of updated filter coefficients may be influenced by various properties of the signal of the forward path. These properties are e.g. evaluated by various sensors or detectors of the hearing aid system, e.g. a feedback estimation unit for detecting whether a given frequency component is likely to be due to feedback or to be inherent in the externally originating part of the input signal (e.g. music). The timing of the adaptive algorithm for calculation and updating filter coefficients (e.g. the time interval between each calculation/update) may be defined by an adaptation rate, which again may be controlled by a step size of the adaptive algorithm.

As indicated, there are already methods/procedures describing how to control an acoustic feedback control system using different measures. Often, though, these are general purpose methods/procedures, and they have only limited performance when used for a specific feedback control system configuration. Typically, certain types of signals coming into hearing aids can trick these methods to wrongly declare a feedback critical situation and hence wrong actions may be taken to make the feedback situation even worse.

A further drawback of these methods is that the estimate of the acoustic feedback path (provided by the adaptive filter) will be biased, if the input signal to the system is not white (i.e. if the input signal has non-zero autocorrelation at time lags different from 0). This means that the anti-feedback system may introduce artefacts when there is a strong autocorrelation (e.g. tones) in the input.

The application of a (small) frequency shift to a signal of the forward path provides increased de-correlation between the output and the input signal, whereby the quality of the feedback estimate provided by the adaptive algorithm is improved.

EP2736271A1 describes a method for applying de-correlation and adaptation rate according to a correlation measure indicative of the correlation between input and output signals of the forward path, by following a predefined scheme including different values of auto-correlation of a signal of the forward path and of cross-correlation between two different signals of the forward path.

However, when the level of external tones (i.e. not feedback) increases, the impact of the de-correlation (e.g. the frequency shift) becomes more and more audible. Indeed, when using a de-correlation method, the interaction between the frequency shift and the adaptive filter for feedback estimation produces a residual time-varying bias for certain critical signals (music, tonal signals) coming into hearing aids, which compromises the quality of the audible output sound.

EP3148214A1 deals with the effect of de-correlation from the frequency shifting in an acoustic feedback cancellation system and discloses a solution to obtain an unbiased estimation for these critical signals coming into hearing aids by removing the slowly time-varying part in the adaptive filter estimation.

Therefore, there is a need to provide a solution for feedback control in a variety of acoustic environments with a view to minimizing audibility of artefacts.

SUMMARY

The present disclosure provides a solution for the technical problem in hearing aids of detecting and/or controlling feedback in different acoustic scenarios with the aim of minimizing the audibility of artefacts. The present application provides a control mechanism to distinguish between feedback critical situations and critical signals, e.g. music or tonal signals, in dependence of a correlation measure (e.g. between the feedback compensated input signal and the output signal).

A Hearing Aid:

According to an aspect of the present application, a hearing aid configured to be worn at and/or in an ear of a user is disclosed. The hearing aid comprises an input transducer, e.g. a microphone, for picking up sound from the environment of the hearing aid and configured to provide at least one electric input signal representing said sound, an output transducer, e.g. a loudspeaker, for converting a processed electric output signal to an output sound or mechanical vibration, and a signal processor connected to the input and output transducers and configured to apply a forward gain to the electric input signal or a signal originating therefrom (and to provide a processed signal based thereon).

The input transducer, the signal processor and the output transducer may form part of a forward path of the hearing aid. The hearing aid may further comprise a feedback control system for compensating for acoustic or mechanical feedback of an external feedback path from the output transducer to the input transducer.

The feedback control system may comprise a feedback estimation unit for providing a feedback estimate signal representative of said external feedback path, a combination unit located in the forward path for combining the electric input signal or a signal derived therefrom and the feedback signal detected by said estimation unit, to provide a resulting feedback corrected signal, a correlation detection unit configured to determine a correlation measure between said feedback corrected signal and said processed signal, e.g. said processed electric output signal, said correlation detection unit being further configured to provide a processed version of said correlation measure.

wherein said feedback control system comprises a feedback detector configured to distinguish between tonal sounds produced by acoustic or mechanical feedback and tonal sounds originating from the environment of a user in dependence of said correlation measure and said processed correlation measure.

The scheme according to the present disclosure has the advantage of allowing an improvement of feedback control (e.g. cancellation), in particular in an acoustic environment comprising tonal components. Thereby an improved hearing aid may be provided.

The feedback estimation unit in said hearing aid may further provide the feedback estimate signal of said external feedback path in dependence of said correlation measure and said processed correlation measure.

The feedback estimation unit in said hearing aid may further comprises an adaptive filter for providing said feedback estimate signal of the external feedback path.

The hearing aid, e.g. the feedback control system, may comprise a control unit for controlling functionality of the hearing aid in dependence on said correlation measure and/or of said processed correlation measure.

The feedback estimation unit may further comprise the control unit. The control unit may be configured to control the adaptation rate of said adaptive filter in dependence of said correlation measure and/or of said processed correlation measure. Said control unit may be configured to increase the adaptation rate of said adaptive filter if the feedback detector indicates presence of feedback. Said control unit may be further configured to decrease the adaptation rate of said adaptive filter if said processed correlation measure is greater than a first threshold value $T_1$, and to increase the adaptation rate of said adaptive filter if said processed correlation measure is less than the first threshold value $T_1$ and said correlation measure is greater than a second threshold value $T_2$.

The correlation measure may be defined as $$C = \frac{\gamma_{eu}}{\sqrt{\sigma_e^2 \cdot \sigma_u^2}}, \tag{1}$$

where $\gamma_{eu}$, denotes the cross-correlation between e(n) and u(n), wherein e(n) and u(n) are the feedback compensated hearing aid input signal and the processed electric output signal, respectively, and where $\sigma_e^2$ and $\sigma_u^2$ denote the signal power of e(n) and u(n), respectively. (cf. e.g. signals fbc (=e(n)) and OUT (=u(n)) in FIG. 1-5.

Moreover, the correlation detection unit in the feedback control system may further comprise a band-pass filter for band-pass filtering said correlation measure. The band-pass filter may be, specifically, a high-pass filter for high-pass filtering said correlation measure. Said correlation detection unit may alternatively or additionally comprise an envelope estimation unit for calculating the spectral envelopes of said correlation measure.

The hearing aid may additionally comprise a frequency-shifting unit for de-correlating the processed electric output signal and the electric input signal. The frequency-shifting unit may be located in the forward path, e.g. between the processor and the output transducer. The control unit may be configured to enable or disable said frequency-shifting unit when feedback is detected (or when a risk of feedback is estimated to be above a certain threshold) by said feedback estimation unit. The control unit may additionally be configured to control said frequency-shifting unit in dependence of the feedback estimate signal provided by said feedback estimation unit.

Use:

In an aspect, use of a hearing aid as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing aids (e.g. hearing instruments), headsets, earphones, active ear protection systems, etc., e.g. in handsfree telephone systems, teleconferencing systems, public address systems, karaoke systems, classroom amplification systems, etc.

A Method of Operating a Hearing Aid:

According to another aspect, a method of operating a hearing aid configured to be worn at of in an ear of a user is provided. The method may comprise providing an input sound to an electric input signal representing sound as picked up by an input transducer;

applying a forward gain to the electric input signal or a signal originating therefrom, and providing a processed signal based thereon;

generating stimuli for an output transducer perceivable by the user as sound based on an output signal equal to or originating from said processed signal;

estimating an external feedback path from the output transducer to the input transducer and providing a feedback estimate signal indicative thereof;

combining the electric input signal or a signal derived therefrom and the feedback estimate signal, to provide a resulting feedback corrected signal;

providing a correlation measure between said feedback corrected signal and said processed signal, e.g. said output signal and providing a processed version of said correlation measure;

distinguishing between tonal sounds produced by acoustic or mechanical feedback and tonal sounds originating from the environment of a user in dependence of said correlation measure and said processed correlation measure.

The method of operating a hearing aid may further comprise providing said feedback estimate signal in dependence of said correlation measure and said processed correlation measure.

A Hearing System:

In a further aspect, a hearing system comprising a hearing aid as described above, in the 'detailed description of embodiments', and in the claims, AND an auxiliary device is moreover provided.

The hearing system may be adapted to establish a communication link between the hearing aid and the auxiliary device to provide that information (e.g. control and status signals, possibly audio signals) can be exchanged or forwarded from one to the other.

The hearing system may comprise an auxiliary device, e.g. a remote control, a smartphone, or other portable or wearable electronic device, such as a smartwatch or the like.

The auxiliary device may be or comprise a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

The auxiliary device may be or comprise an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid.

The auxiliary device may be or comprise another hearing aid. The hearing system may comprise two hearing aids adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing aid or a hearing system described above in the 'detailed description of embodiments', and in the claims. The APP may be configured to run on cellular phone, e.g. a smartphone, or on another portable device allowing communication with said hearing aid or said hearing system.

A Computer Program:

A computer program (product) comprising instructions which, when the program is executed by a computer, cause the computer to carry out (steps of) the method described above, in the 'detailed description of embodiments' and in the claims is furthermore provided by the present application.

A Computer Readable Medium

In an aspect, the functions may be stored on or encoded as one or more instructions or code on a tangible computer-readable medium. The computer readable medium includes computer storage media adapted to store a computer program comprising program codes, which when run on a processing system causes the data processing system to perform at least some (such as a majority or all) of the steps of the method described above, in the and in the claims.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System

In an aspect, a data processing system comprising a processor adapted to execute the computer program for causing the processor to perform at least some (such as a majority or all) of the steps of the method described above and in the claims.

Definitions

In the present context, a hearing aid, e.g. a hearing instrument, refers to a device which is adapted to improve, augment and/or protect the hearing capability of a user by receiving an acoustic signal from a user's surroundings, generating a corresponding audio signal, possibly modifying the audio signal and providing the possibly modified audio signal as an audible signal to at least one of the user's ears. 'Improving or augmenting the hearing capability of a user' may include compensating for an individual user's specific hearing loss. The "hearing device" may further refer to a device such as a hearable, an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of the middle ear of the user.

The hearing aid is configured to be worn in any known way. This may include i) arranging a unit of the hearing aid behind the ear with a tube leading air-borne acoustic signals into the ear canal or with a receiver/loudspeaker arranged close to or in the ear canal and connected by conductive wires (or wirelessly) to the unit behind the ear, such as in a Behind-the-Ear type hearing aid, and/or ii) arranging the hearing device entirely or partly in the pinna and/or in the ear canal of the user such as in an In-the-Ear type hearing aid or In-the-Canal/Completely-in-Canal type hearing aid, or iii) arranging a unit of the hearing device attached to a fixture implanted into the skull bone such as in a Bone Anchored Hearing Aid, or iv) arranging a unit of the hearing device as an entirely or partly implanted unit such as in a Bone Anchored Hearing Aid. The hearing aid may be implemented in one single unit (housing) or in a number of units individually connected to each other.

A "hearing aid system" refers to a system comprising one or two hearing aids, and a "binaural hearing aid system" refers to a system comprising two hearing aids where the devices are adapted to cooperatively provide audible signals to both of the user's ears. The hearing aid system or binaural hearing aid system may further include one or more auxiliary device(s) that communicates with at least one hearing aid, the auxiliary device affecting the operation of the hearing aid and/or benefitting from the functioning of the hearing aid. A wired or wireless communication link between the at least one hearing aid and the auxiliary device is established that allows for exchanging information (e.g. control and status signals, possibly audio signals) between the at least one hearing aid and the auxiliary device. Such auxiliary devices may include at least one of a remote control, a remote microphone, an audio gateway device, a wireless communication device, e.g. a mobile phone (such as a smartphone) or a tablet or another device, e.g. comprising a graphical interface, a public-address system, a car audio system or a music player, or a combination thereof. The audio gateway may be adapted to receive a multitude of audio signals such as from an entertainment device like a TV or a music player, a telephone apparatus like a mobile telephone or a computer, e.g. a PC. The auxiliary device may further be adapted to (e.g. allow a user to) select and/or combine an appropriate one of the received audio signals (or combination of signals) for transmission to the at least one hearing aid. The remote control is adapted to control functionality and/or operation of the at least one hearing aid. The function of the remote control may be implemented in a smartphone or other (e.g. portable) electronic device, the smartphone/electronic device possibly running an application (APP) that controls functionality of the at least one hearing aid.

In general, a hearing aid includes i) an input unit such as a microphone for receiving an acoustic signal from a user's surroundings and providing a corresponding input audio signal, and/or ii) a receiving unit for electronically receiving an input audio signal. The hearing aid further includes a signal processor for processing the input audio signal and an output unit for providing an audible signal to the user in dependence on the processed audio signal.

The input unit may include multiple input microphones, e.g. for providing direction-dependent audio signal processing. Such directional microphone system is adapted to (relatively) enhance a target acoustic source among a multitude of acoustic sources in the user's environment and/or to attenuate other sources (e.g. noise). In one aspect, the directional system is adapted to detect (such as adaptively detect) from which direction a particular part of the microphone signal originates. This may be achieved by using conventionally known methods. The signal processor may include an amplifier that is adapted to apply a frequency dependent gain to the input audio signal. The signal processor may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

In the present disclosure, a novel scheme that is specifically advantageous for a feedback control system using adaptive filter and a frequency shift in the forward path to decorrelate signals.

This method can be used to determine feedback critical situations, and it can also determine when there is a very strong auto-correlated signal coming into the hearing aids, which is an important information that can then be used to control an acoustic feedback cancellation system in an appropriate way.

Figure 1:
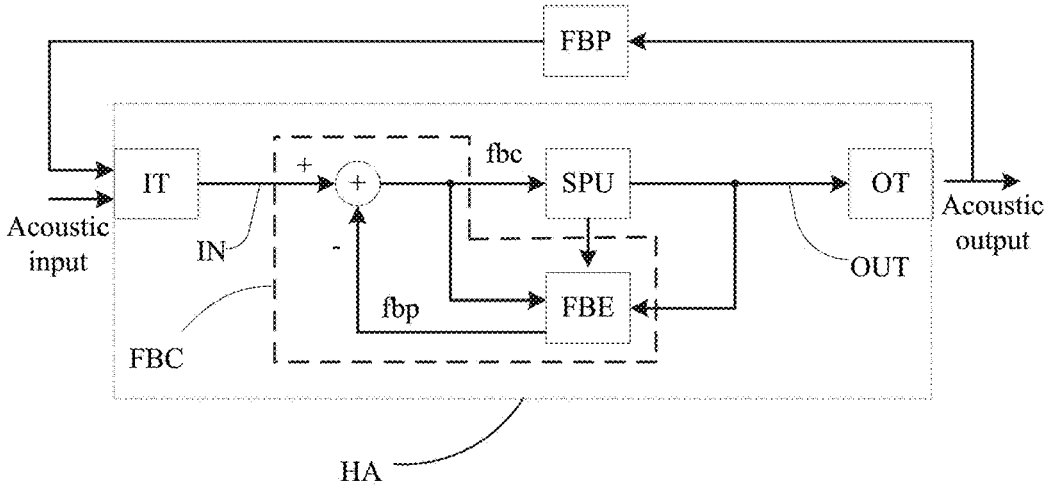
FIG. 1 illustrates an embodiment of a hearing comprising a feedback cancellation system according to prior art.

FIG. 1 illustrates an example of a hearing aid according to the prior art. The hearing aid (HA) is adapted to be located at or in an ear of a user (U) and to compensate for a hearing loss of the user. The hearing aid (HA) comprises a forward path for processing an input signal representing sound in the environment. The forward path comprises at least one input transducer (IT) (e.g. one or more microphones), for picking up sound ('Acoustic input') from the environment of the hearing aid (HA) and providing respective at least one input signal (IN). The forward path further comprises a signal processor (SPU) for processing the at least one electric input signal (IN) or one or more signals originating therefrom and providing one or more processed signals (OUT) based thereon. The forward path further comprises an output transducer (OT, e.g. a loudspeaker or a vibrator) for generating stimuli perceivable by the user (U) as sound ('Acoustic output') based on the one or more processed signals (OUT). The hearing aid (HA) further comprises a feedback control system (FBC) for feedback control (e.g. attenuation or removal), wherein said feedback control system (FBC) comprises a feedback estimation unit (FBE) for estimating a current feedback path (FBP) from the output transducer (OT) to each of the at least one input transducer (IT) and providing a respective feedback measure (fbp) indicative thereof. A further element comprised in the feedback control system as shown in FIG. 1 is a combination unit (her a summation unit, '+') for combining the electric input signal (IN) or a signal derived therefrom and the feedback signal (fbp) provided by said feedback estimation unit (FBE) (here subtracting feedback path estimate fbp from input signal IN), to provide a resulting feedback corrected signal (fbc). A problem which may arise in a feedback control system (FBC) as the one shown in FIG. 1 is that certain types of signals coming into the hearing aid (HA) from the external environment of the user (U) can trick the feedback control system (FBC) (or a feedback detector separate therefrom) to wrongly declare a feedback critical situation and hence induce the combination unit (+) to compensate for a non-existing feedback howling signal (e.g. by providing a wrong feedback estimate that includes a tonal input from the environment, which ideally should not be subtracted from the input signal).

Figure 2:
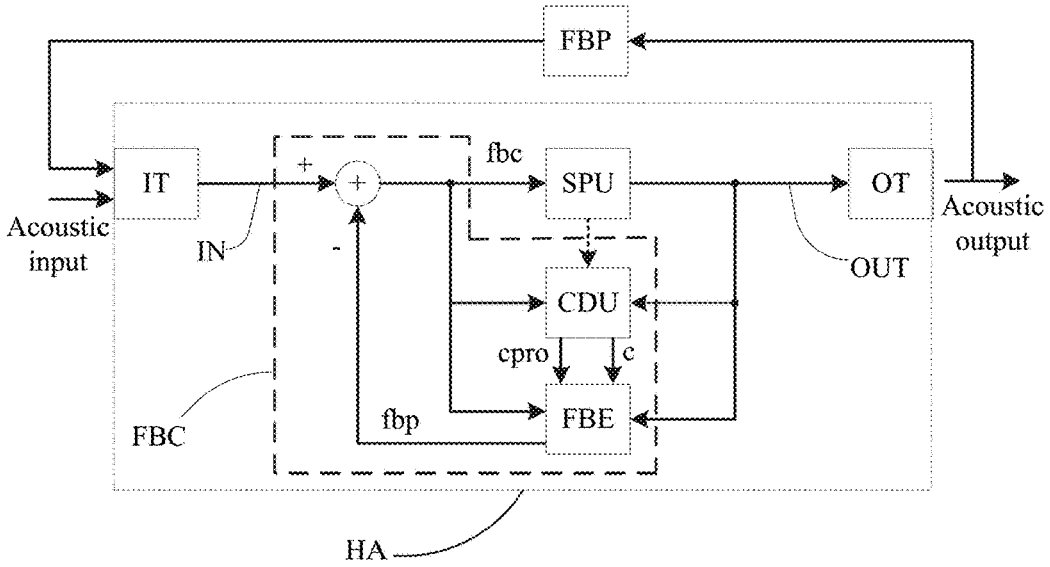
FIG. 2 illustrates a first embodiment of a hearing aid according to the present disclosure.

FIG. 2 illustrates an embodiment of a hearing aid (HA) according to the present disclosure. The embodiment of FIG. 2 is similar to the embodiment of FIG. 1 but additionally comprises a correlation detection unit (CDU), which provides a value of the correlation measure (c) between the feedback corrected signal (fbc) and a processed version thereof (cf. dashed arrow from unit SPU to CDU in FIG. 2), e.g. the output signal (OUT, cf. solid arrow from unit SPU to CDU) and a processed value (cpro) of the correlation measure (c). As shown in FIG. 2 these two measures are provided as inputs for the feedback estimation unit (FBE) and are utilized to give a better estimation of the presence of feedback compared to prior art, since they allow the feedback estimation unit (FBE) to distinguish between tonal sounds produced by critical signals (such as musical tones)—generated in the external environment of the hearing aid (HA) user (U)— and tonal sounds produced by mechanical or acoustical feedback from output to input transducer(s). Further an adaptation rate (e.g. a step size) of an adaptive algorithm of an exemplary adaptive filter of the feedback estimation unit (FBE) may be controlled in dependence of the correlation (c) and/or the processed value (cpro) of the correlation measure (c), cf. e.g. FIG. 4.

Figure 3:
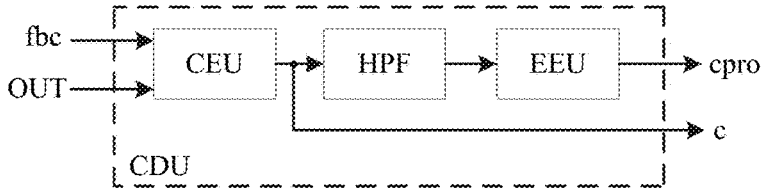
FIG. 3 illustrates a block diagram of an embodiment of a correlation detection unit in a hearing aid according to the present disclosure.

FIG. 3 illustrates in detail an embodiment of the correlation detection unit (CDU) as presented in FIG. 2. The correlation detection unit (CDU) (cf. dashed outline in FIG. 3) in this configuration comprises a correlation estimation unit (CEU), which evaluates the correlation measure between the feedback corrected signal (fbc) and the output signal (OUT) as $$c = \frac{\gamma_{fbc-OUT}}{\sqrt{\sigma_{fbc}^2 \cdot \sigma_{OUT}^2}}, \tag{1}$$

where $\gamma_{fbc-OUT}$ denotes the cross-correlation between fbc and OUT, wherein fbc and OUT are the feedback compensated hearing aid input signal (fbe=IN-fbp in FIG. 2) and the output signal (OUT in FIG. 2), respectively, and where $\sigma_{fbc}^2$ and $\sigma_{OUT}^2$ denote the signal power of fbc and OUT, respectively. This first correlation measure c constitutes one of the outputs provided by the correlation detection unit (CDU). Moreover, the next two blocks (HPF, EEU) have the function of processing the correlation signal c and producing the additional output in the form of the processed value cpro of the correlation measure c. The first block connected to the correlation estimation unit (CEU) in the configuration shown in FIG. 3 is a high-pass filter (HPF), providing the high-frequency part of the correlation measure (c) signal. The cut-off frequency of the high-pass filter may be e.g. 3, 5, 10, 20, or 30 Hz, e.g. less than 50 Hz. The second block connected to the high-pass filter (HPF), as shown in FIG. 3, is an envelope estimation unit (EEU) for estimating the spectral envelopes of said high-pass filtered correlation measure (c) and providing the processed correlation measure (cpro) as additional output of the correlation detection unit (CDU). Other correlation measures than the one represented by expression (1) above may be used. Other signals of the forward path than 'fbc' and 'OUT' may be used in the correlation measure.

Figure 4:
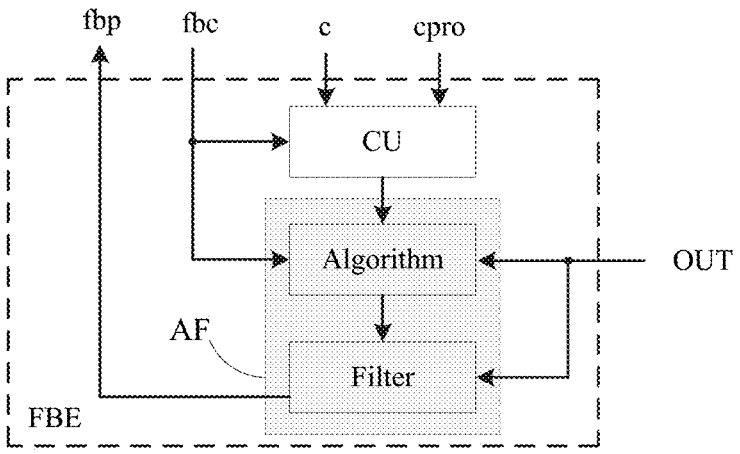
FIG. 4 illustrates a block diagram of an embodiment of a feedback estimation unit in a hearing aid according to the present disclosure, where the feedback estimation unit comprises an adaptive filter.

FIG. 4 illustrates an embodiment of the feedback estimation unit (FBE) as shown in FIG. 2. The feedback estimation unit (FBE) in this configuration comprises an adaptive filter (AF) configured to adaptively estimate the feedback paths(s) (FBP) and to output a feedback measure (fbp) indicative thereof. The adaptive filter (AF) comprises an adaptive algorithm part (Algorithm) for determining the update filter coefficients, which are fed and applied to a variable filter part (Filter) of the adaptive filter (AF). The feedback estimation unit as depicted in FIG. 4 further comprises a control unit (CU) for controlling the adaptation rate of the adaptive algorithm of the adaptive filter (AF) in dependence of the correlation measure (c) and of the processed correlation measure (cpro). In particular, if the feedback estimation unit (FBE) (e.g. a feedback detector), by observing the value of the correlation measure (c) and/or of the processed correlation measure (cpro), detects the presence of feedback, said control unit (CU) may increase the adaptation rate of the adaptive filter (AF); on the contrary, if the feedback estimation unit (FBE), by observing the value of the correlation measure (c) and/or of the processed correlation measure (cpro), detects the presence of a non-feedback-related tonal sound, said control unit (CU) may decrease the adaptation rate of the adaptive filter (AF) (or entirely stop the update of the filter coefficients, i.e. set the adaptation rate to zero).

Figure 5:
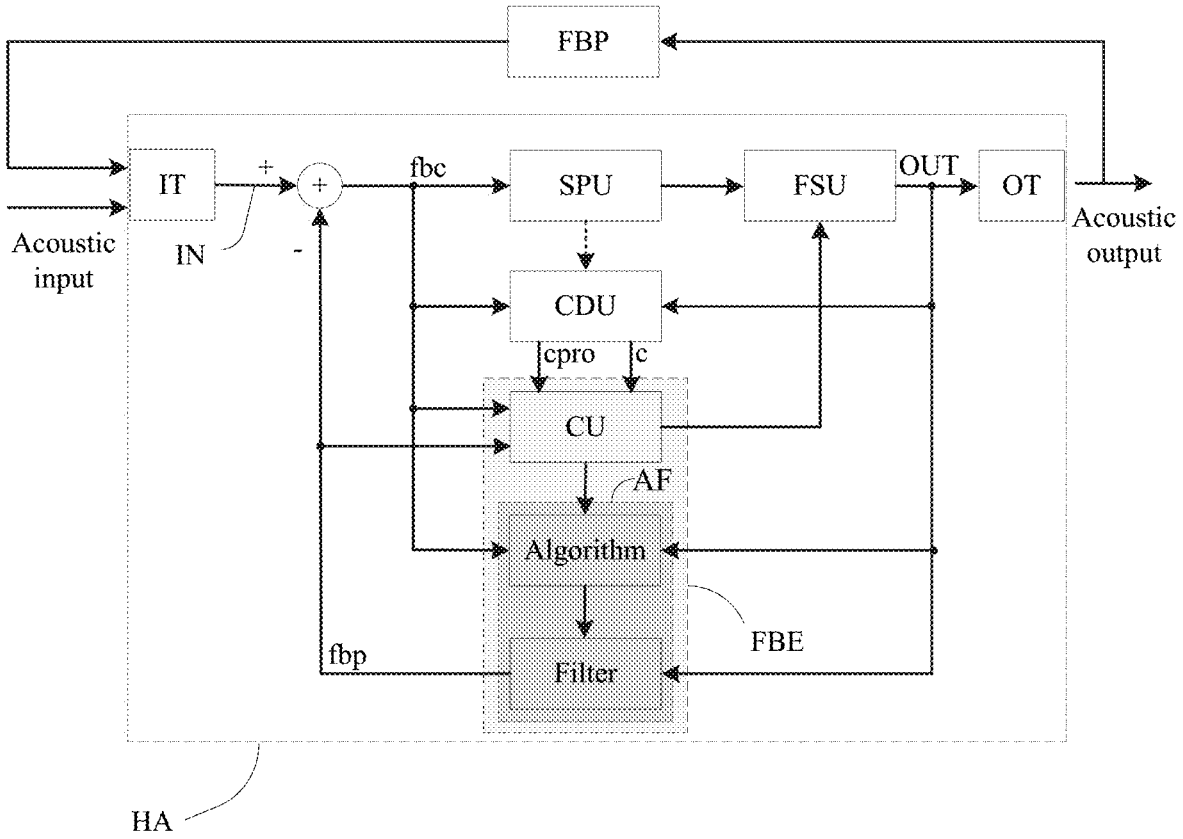
FIG. 5 shows an embodiment of a hearing device according to the present disclosure, where the hearing aid includes a frequency-shifting unit.

FIG. 5 shows an additional embodiment of a hearing aid (HA) according to the present disclosure, similar to FIG. 2. The difference from the configuration illustrated in FIG. 2 is that it further comprises a frequency shifting unit (FSU) (located in the forward path of the hearing aid) for decorrelating the processed signal from the processor (SPU) and the electric input signal, which is useful for alleviating the generally biased adaptive filter (AF) estimation. The feedback estimation unit (FBE), e.g. the control unit (CU) may comprise a feedback detector enabling a discrimination between tonal signals originating from feedback and from the (external) environment (of the user). The control unit (CU) of the feedback estimation unit (FBE) may be configured to enable the frequency shifting unit (FSU) when feedback is detected (and e.g. disable the frequency shifting unit (FSU) when no feedback is detected). Moreover, the control unit (CU) may control the frequency shifting unit (FSU) in dependence of a feedback control signal provided by said feedback detector (e.g. to control the amount of frequency shift). Finally, the control unit (CU) may control the frequency shifting unit (FSU) in dependence of the correlation measure (c) and/or of the processed correlation measure (cpro). As shown in [Guo & Kuenzle, 2016], there is an interaction between the frequency shift and the adaptive filter (AF) for feedback estimation, so that there is a residual time-varying bias for certain critical signals (music, tonal signals) picked up by hearing aids. Hence, the correlation measure (c) would reveal these critical signals. For this reason, being able to distinguish between tonal sounds produced by feedback and tonal sounds coming from the external environment of the user (U), allows the control unit (CU) to regulate the activity of the frequency shifting unit (FSU) in a more accurate way. Indeed, the control unit (CU) may deactivate the frequency shifting unit (FSU) when an external tonal sound is detected, which allows the user (U) to experience a non-distorted tonal sound, e.g. music. In a different situation, when feedback is detected, the control unit (CU) may activate the frequency shifting unit (FSU) and may additionally control the frequency shifting value according to the correlation measure (c) and/or according to the processed correlation measure (cpro), which alleviates the situation of biased adaptive filter (AF) estimation.

Figure 6:
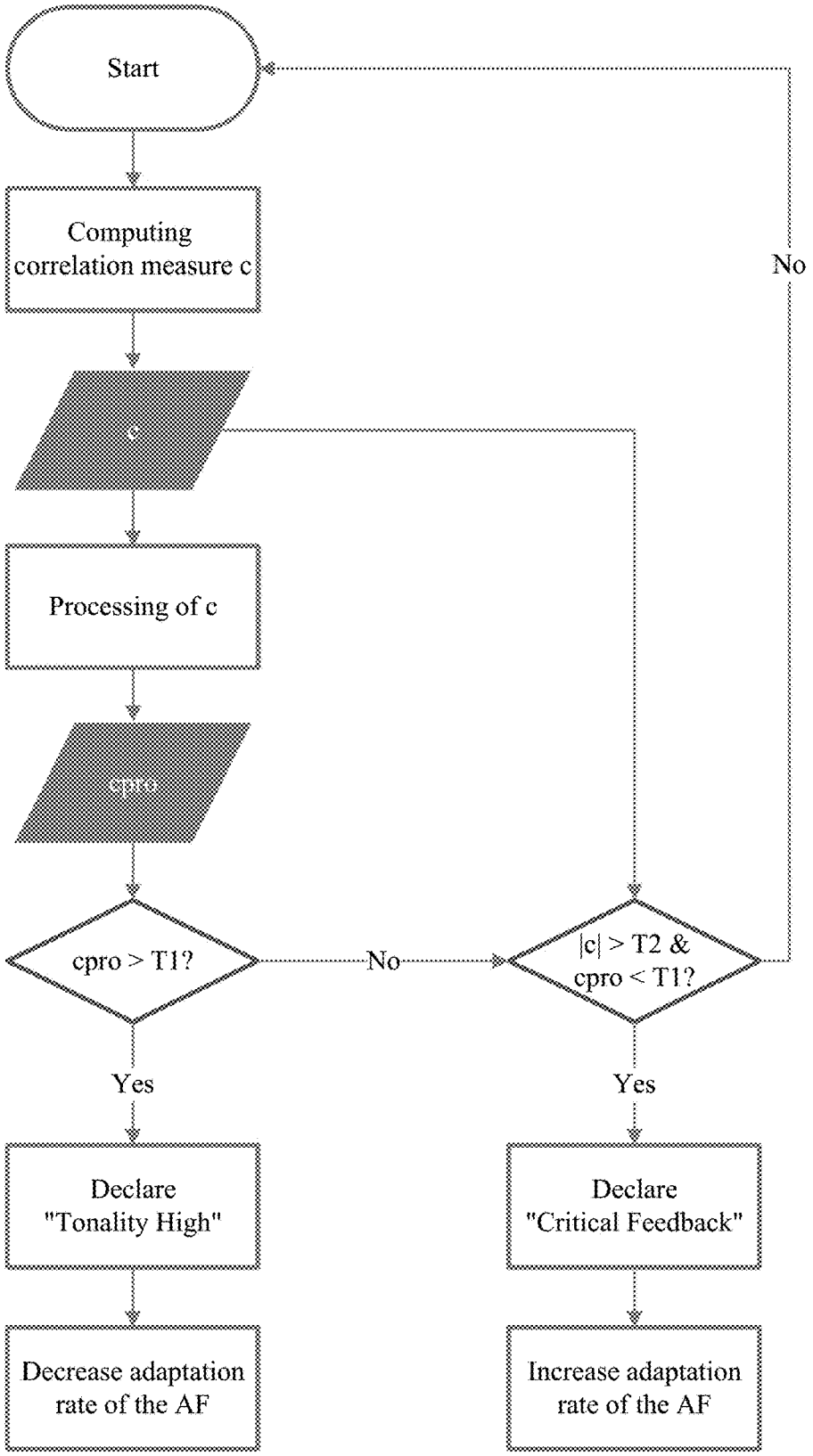
FIG. 6 illustrates a flow diagram of the feedback estimation mechanism according to the present disclosure.

FIG. 6 illustrates into details the feedback detection mechanism according to an embodiment of the present disclosure in the form of a flow diagram of a part of a method of operating a hearing aid. The procedure is initiated from 'Start' in the flow diagram in that the correlation detection unit (CDU) first computes the correlation measure (c) and then, from the correlation measure (c), the processed version (cpro) of said correlation. These two measures are then provided as input to the feedback estimation unit (FBE) (e.g. to a feedback detector of the control unit (CU)) to distinguish between feedback and tonal sounds picked up by the input transducer (IT) from the external environment of the user (U). FIG. 6 shows that, if the value of the processed correlation measure (cpro) exceeds a first threshold value (T1), a situation, where external tones (Declare 'Tonality High') are present, is detected; in this scenario, the control unit (CU) in the feedback estimation unit (FBE) may decrease (e.g. to zero) the adaptation rate of the adaptive filter (AF). On the contrary, if the processed correlation measure (cpro) does not exceed said first threshold (T1) but the absolute value of the correlation measure (c) is greater than a second threshold value (T2) (or, equivalently, the correlation measure (c) is either greater than T2 or less than −T2), a situation of feedback is detected (Declare 'Critical Feedback'); in this case, the control unit (CU) in the feedback estimation unit (FBE) may increase the adaptation of the adaptive filter (AF). If the latter ($|c|>T2$ AND $cpro<T1$) is NOT fulfilled, the procedure is started from the beginning (' Stare).

It should also be mentioned, that when there is a combination of critical feedback occurring and critical signals (music etc.) coming into hearing aids, indicated by the situation where the correlation measure (cpro) exceeds said first threshold (T1) and the absolute value of the correlation measure (c) is greater than a second threshold value (T2) (or, equivalently, the correlation measure (c) is either greater than T2 or less than −T2), the above feedback detection mechanism declares the presence of an externally-produced tone (Declare 'Tonality High'). Since in such a situation the adaptive filter (AF) for feedback cancellation systems would face an extremely challenging situation, it is hard for the adaptive filter to converge anyway and hence it is indeed advantageous to slow down its adaptation rate. Therefore, the mechanism as disclosed in the present application is able handle correctly also this additional critical acoustic situation.

Figure 7:
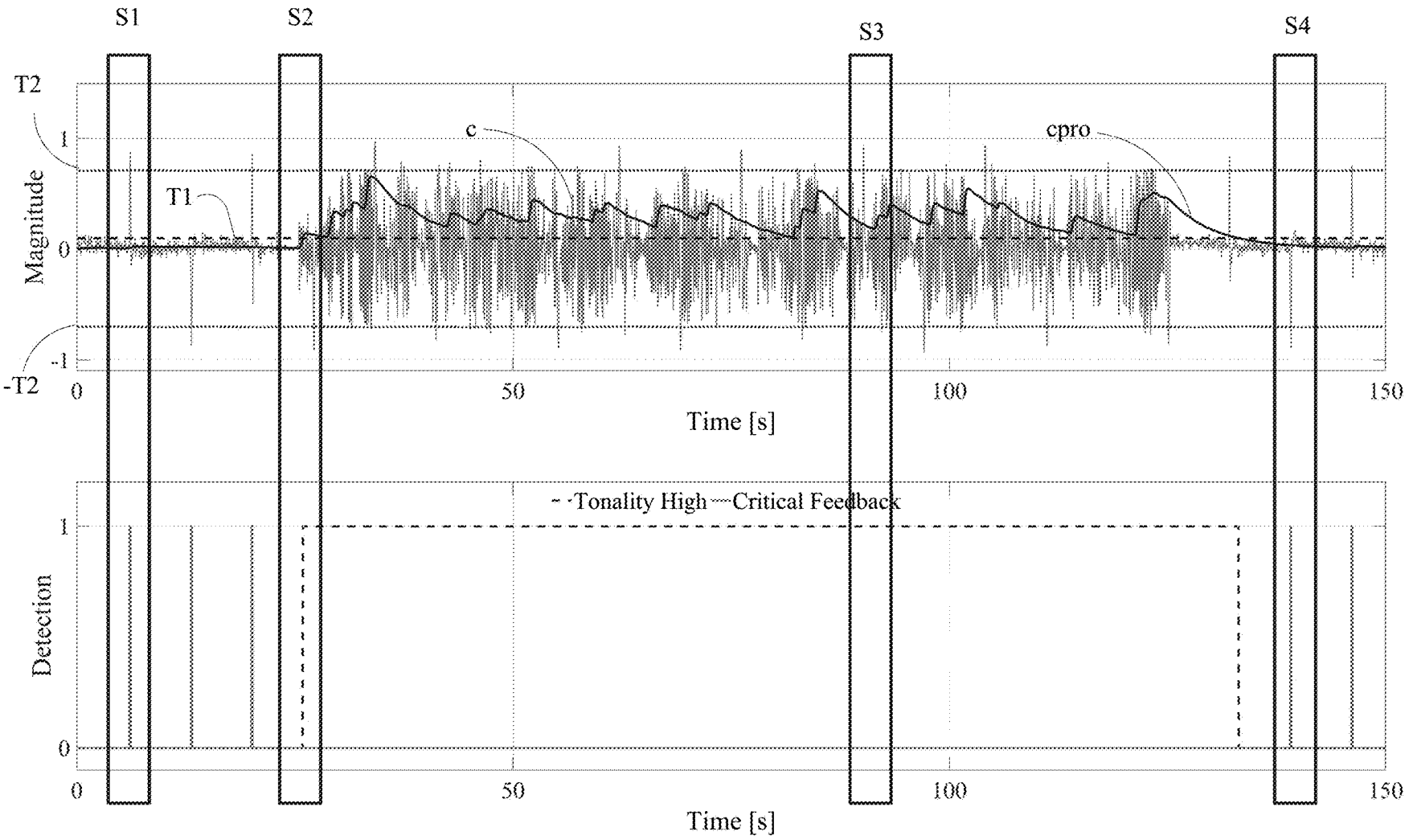
FIG. 7 shows simulation results for the feedback detection mechanism in a hearing aid according to the present disclosure.

FIG. 7 illustrates simulation results to show how the correlation measure (c) and its processed version (cpro) are used in the feedback detection mechanism according to the present disclosure. The top graph shows magnitude versus time (s) of measures 'c' and 'cpro' for an audio signal comprising tonal elements (generated by feedback as well as having external origin, e.g. music). The waveform has an extension between 0 and 150 s. During the simulations, critical feedback has been created for every seventh second (cf. single (alternatingly positive and negative) 'spikes' every $7^{th}$ s), and in the middle part of the simulation (from 25 seconds to 130 seconds) highly auto-correlated music signal comes into hearing aid. The simulation result shows that using the method as disclosed in the present application, the feedback estimation unit (FBE) can determine both a situation of critical feedback and a situation of external tones in signals coming into hearing aids. The top graph shows the magnitude levels of the correlation measure (c) as a fast varying waveform extending between 1 and −1 and that of the processed correlation measure (cpro) as a solid waveform taking on values in the range between 0 and 1. It additionally indicates the threshold values T1 (for 'cpro') and T2 (for e.g. referred to in FIG. 6). Consequently, the bottom graph shows the detection performed by the feedback estimation unit (FBE) (e.g. the control unit thereof, e.g. a feedback detector) according to the values of the correlation measure (c) and to the processed correlation measure (cpro).

Vertical narrow rectangles denoted S1, S2, S3, S4 focus on four situations distributed in time over the extension of the waveform. The first and last situation (S1 and S4, respectively) shows peaks in the values of the correlation measure (c) corresponding to the generated feedback sound: since c exceeds the threshold T2 in the first case (S1) and the negative of the threshold T2 (−T2) in the last case and since the processed correlation measure (cpro) is less than the first threshold T1 (in short |c|>T2 AND cpro<T1, cf. FIG. 6), a situation of feedback ('Critical Feedback' in FIG. 6) is detected by the feedback estimation unit (FBE) in both situations S1 and S4.

In a second situation (S2), at second 25, while the simulation value for the correlation measure (c) is considerably less than T2 (|c|<T2), the value of the corresponding processed correlation measure (cpro) is increasing and becomes greater than T1 (cpro>T1); as expected, the detection output of the simulations as shown in the bottom graph is of a non-feedback related tone ('Tonality high in FIG. 6).

Finally, in the third scenario (S3) the correlation value (c) clearly exceeds the threshold T2 (|c|>T2); however, since the processed correlation measure (cpro) exceeds as well the threshold value T1 (cpro>T1), indicating a combination of critical feedback occurring and critical signals (music etc.) coming into hearing aids, the feedback estimation unit (FBE) chooses to classify this specific situation as a critical non-feedback related signal (cf. e.g. FIG. 6). As mentioned above, this is the preferred solution, since it determines the decrease of the adaptation rate of the adaptive filter (AF) and, therefore, allows the adaptive filter (AF) to better handle this complex acoustical situation.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects. Reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2736271A1 (Oticon) 28.05.2014

[Guo & Kuenzle, 2016] Guo, Meng and Bernhard Kuenzle. "On the periodically time-varying bias in adaptive feedback cancellation systems with frequency shifting." 2016 IEEE International Conference on Acoustics, Speech and Signal Processing (ICASSP) (2016): 539-543.

EP3148214A1 (Oticon) 29.03.2017

The invention claimed is:

1. A feedback control system for compensating for acoustic or mechanical feedback of an external feedback path from an output transducer to an input transducer of a hearing device, said feedback control system comprising:

a feedback estimation unit configured to provide a feedback estimate signal of the external feedback path;

a combination unit located in a forward path of the hearing device that generates a processed electric output signal, said combination unit being configured to combine an electric input signal or a signal derived therefrom and the feedback estimate signal to provide a feedback corrected signal; and a correlation detection unit configured to determine a correlation measure between the feedback corrected signal and the processed electric output signal, said correlation detection unit being further configured to provide a processed version of the correlation measure, wherein said feedback estimation unit comprises a feedback detector configured to distinguish between tonal sounds produced by acoustic or mechanical feedback and tonal sounds originating from an environment of a user in dependence of the correlation measure and the processed correlation measure.

2. A feedback control system according to claim 1, wherein said feedback estimation unit is further configured to provide the feedback estimate signal of the external feedback path in dependence of the correlation measure and the processed correlation measure.

3. A feedback control system according to claim 1, wherein said feedback estimation unit comprises an adaptive filter for providing the feedback estimate signal of the external feedback path.

4. A feedback control system according to claim 3, wherein said feedback estimation unit further comprises a control unit for controlling an adaptation rate of said adaptive filter in dependence of the correlation measure and the processed correlation measure.

5. A feedback control system according to claim 4, wherein said control unit is configured to increase the adaptation rate of said adaptive filter when said feedback detector indicates a presence of feedback.

6. A feedback control system according to claim 4, wherein said control unit is configured to decrease the adaptation rate of said adaptive filter when said feedback detector indicates presence of a tonal sound originating from the environment of the user.

7. A feedback control system according to claim 4, wherein said control unit is configured to decrease the adaptation rate of said adaptive filter when said processed correlation measure is greater than a first threshold value $T_1$, and wherein said control unit is further configured to increase the adaptation rate of said adaptive filter when the processed correlation measure is less than a first threshold value $T_1$ and the absolute value of the correlation measure is greater than a second threshold value $T_2$.

8. A feedback control system according to claim 1, wherein said correlation detection unit further comprises a band-pass filter for band-pass filtering the correlation measure.

9. A feedback control system according to claim 1, wherein said correlation detection unit further comprises a high-pass filter for high-pass filtering the correlation measure.

10. A feedback control system according to claim 1, wherein said correlation detection unit further comprises an envelope estimation unit for calculating the spectral envelopes of the correlation measure.

11. A feedback control system according to claim 10, wherein said correlation detection unit calculates the processed correlation measure by first high-pass filtering the correlation measure and by, then, calculating the spectral envelopes of the high-pass filtered correlation measure.

12. A feedback control system according to claim 1, wherein the forward path of the hearing device includes a frequency-shifting unit for de-correlating the processed electric output signal and the electric input signal.

13. A feedback control system according to claim 12, wherein said frequency-shifting unit is enabled or disabled when feedback is detected or not detected, respectively, by said feedback detector.

14. A feedback control system according to claim 12 configured to control said frequency-shining unit in dependence of the feedback estimate signal provided by said feedback estimation unit.

15. A method of compensating for acoustic or mechanical feedback of an external feedback path from an output transducer to an input transducer of a hearing device, the method comprising:

estimating for acoustic or mechanical feedback of the external feedback path from the output transducer to the input transducer and providing a feedback measure indicative thereof;

combining an electric input signal or a signal derived therefrom and the feedback estimate to provide a resulting feedback corrected signal;

providing a correlation measure between the feedback corrected signal and a processed signal generated by a forward path of the hearing device and a processed version of the correlation measure; and distinguishing between tonal sounds produced by acoustic or mechanical feedback and tonal sounds originating from an environment of a user in dependence of the correlation measure and the processed correlation measure.

16. A method according to claim 15, the method further comprising providing the feedback estimate signal of the external feedback path in dependence of the correlation measure and the processed correlation measure.

17. A method according to claim 15, wherein the feedback of the external feedback path is estimated via adaptive filtering.

18. A method according to claim 17, wherein an adaptation rate of the adaptive filtering is controlled in dependence of the correlation measure and the processed correlation measure.

19. A method according to claim 18, wherein the adaptation rate of the adaptive filtering is increased when a presence of feedback is detected.

20. A method according to claim 18, wherein the adaptation rate of the adaptive filtering is decreased when presence of a tonal sound originating from the environment of the user is detected.

* * * * *